United States Patent [19]

Gregory

[11] 4,295,681

[45] Oct. 20, 1981

[54] SEAT HAVING LUMBAR SUPPORT AND VERTICAL HEIGHT ADJUSTMENT MECHANISM THEREFOR

[75] Inventor: Leslie A. Gregory, Northampton, England

[73] Assignee: UOP Inc., Des Plaines, Ill.

[21] Appl. No.: 122,152

[22] Filed: Feb. 19, 1980

[51] Int. Cl.[3] ..... A47C 3/00; A47C 7/46

[52] U.S. Cl. ..... 297/284

[58] Field of Search ..... 297/284, 408, 409; 267/89

[56] References Cited

U.S. PATENT DOCUMENTS

| | | | |
|---|---|---|---|
| 3,973,797 | 8/1976 | Obermeier et al. | 297/284 |
| 4,019,777 | 4/1977 | Hayashi | 297/284 |
| 4,148,522 | 4/1979 | Sakurada et al. | 297/284 |
| 4,182,533 | 1/1980 | Arndt et al. | 297/284 |

*Primary Examiner*—Francis K. Zugel

*Attorney, Agent, or Firm*—James R. Hoatson, Jr.; Barry L. Clark; William H. Page, II

[57] ABSTRACT

A seat backrest having a contourable upholstered portion supported by a rigid frame portion includes means to produce a desired supporting contour in the lumbar region of the seat occupant. The contour-producing means includes a lumbar pad, a pair of link members connecting the lumbar pad to the frame, and a double threaded shaft means operable by a seated occupant from the side of the backrest for moving and holding the link members in an infinite number of fixed, generally horizontal positions forward of the frame. The position of maximum lumbar support can be adjusted vertically by pivoting the link members and lumbar pad by means of a pin which is engaged with an angled slot in a sliding plate.

8 Claims, 7 Drawing Figures

SEAT HAVING LUMBAR SUPPORT AND VERTICAL HEIGHT ADJUSTMENT MECHANISM THEREFOR

BACKGROUND OF THE INVENTION

The present invention relates to vehicle seats and particularly to seat backrests of the type which include internal structures for selectively adjusting the seat cushion contour to provide varying degrees of lumbar support to a seated occupant.

The desirability for providing support for the lumbar region of the back of a seat occupant has long been recognized and various patents, including U.S. Pat. Nos. 3,807,794; 3,890,000; 3,948,558; 3,973,797; 4,155,592; 4,156,544; 4,162,807 and 4,182,533 disclose structures for permitting a fore and aft adjustment of an internal lumbar pad within a back cushion. A co-pending application, Ser. No. 79,861, filed Sept. 28, 1979, and assigned to a common assignee, also discloses such a structure and such disclosure is incorporated by reference herein. U.S. Pat. No. 4,148,522 discloses both fore and aft and vertical adjustment of a lumbar supporter. However, the adjustment is very limited and there are only two vertical positions and three fore and aft positions possible.

SUMMARY

It is among the objects of the present invention to provide an infinitely adjustable lumbar support for a seat back which is simple to operate by a seated occupant, which provides positive positioning of the lumbar support in both fore and aft and vertical directions, which is capable of resisting large forces which might be exerted into the seat back and which has a very substantial range of movement while requiring very little or no additional space for installation as compared to a standard cushion. A still further object is to provide a lumbar support which progressively increases the amount of positive support provided by the seat cushion as the lumbar support portion is extended forwardly.

The above and other objects are attained by the apparatus of the present invention wherein a lumbar pad member is supported for generally fore and aft movement into or out of the seat back cushion by a pair of support arms or link members which are pivotally mounted to the pad member and which also pivot about trunnions on a pair of adjusting nuts which move axially relative to a threaded shaft carried by the seat back frame. The threaded shaft is mounted for rotation in spaced bearings carried by brackets which are fixed to an angle member attached to the seat back frame. A knob is mounted on one end of the shaft and projects to the exterior of the side of the seat back for easy manual operation by the seat occupant. The shaft includes a portion with a right hand thread and a portion with a left hand thread so that rotation of the knob will cause the aforementioned adjusting nuts to move either toward or away from each other to, respectively, cause the link members and lumbar pad to move toward either their retracted or outermost positions. The lumbar pad and support arms can be tilted slightly up or down to cause the point of maximum lumbar support to be lower or higher, respectively, than when the support arms are not tilted. This tilting movement is provided by mounting an elongated bracket for rotational movement about the threaded shaft and providing it with a pair of longitudinal slots which engage pins extending radially from the pivot axes of the adjusting nuts. A pin projecting from the elongated bracket engages an angled slot in a sliding plate carried by the seat back frame. When the sliding plate is moved axially of the threaded shaft by means of a manually operated actuating knob, the pin on the elongated bracket is forced to move slightly forwardly or rearwardly due to its being in contact with the sides of the angled slot. The movement of the pin, of course, causes the elongated bracket to move and the elongated bracket causes the adjusting nuts and the support arms and lumbar pad carried by them to move.

DESCRIPTION OF THE PREFERRED EMBODIMENT

Figure 1:
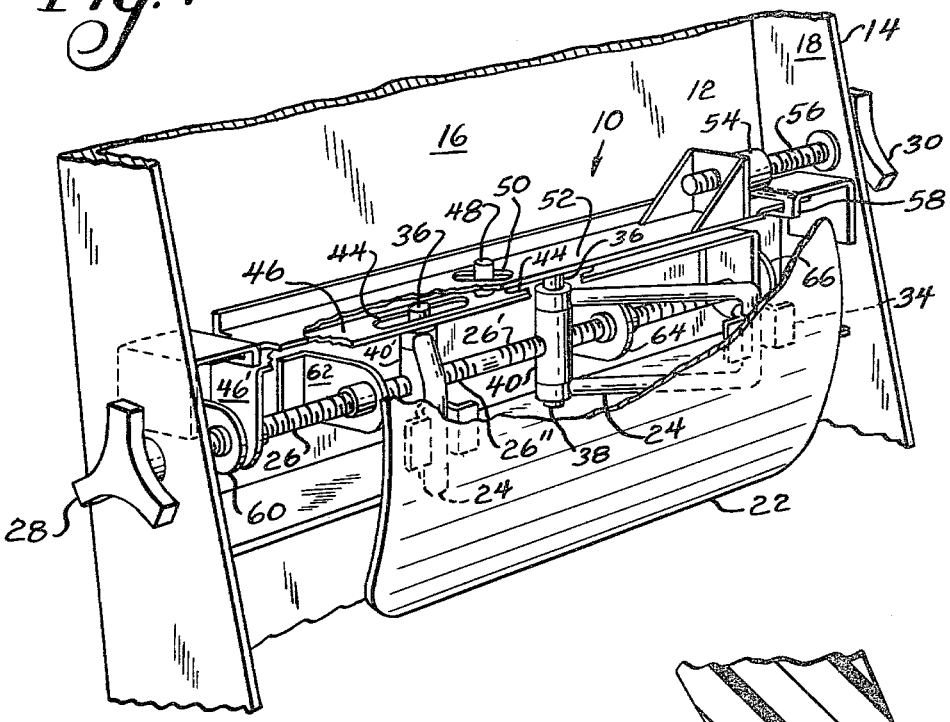
FIG. 1 is a fragmentary, partially broken away perspective view of a seat back frame member incorporating the lumbar assembly in an intermediate adjustment position with the seat back cushion removed for clarity.

Referring to FIG. 1, the improved lumbar adjustment assembly is indicated generally at 10 as being disposed in a recessed portion 12 of a seat back frame 14 having a back panel portion 16 and side panel portions 18. The generally horizontal, elongated lumbar pad member 22 has a convex forward surface and is adapted to be moved by the adjustment assembly in both an in and out direction and also in a slightly tilting direction. The lumbar pad 22 is pivotally mounted at the outer end of pivot links 24. The pivot links 24 are mounted at their inner ends for movement relative to threaded shaft 26 which is journaled for rotation in the recessed portion 12 between the side panels 18. The shaft 26 has right and left hand threaded portions 26', 26'' which permit the inner ends of the links 24 to be moved axially of the shaft 26 and either toward or away from each other depending upon the direction of rotation of a manually operated fore and aft adjustment handle 28 which is mounted on the shaft 26. Tilting movement of the lumbar pad 22 is provided by rotating the handle 30.

The specific structure which provides the aforementioned fore and aft and tilting movement of the lumbar pad 22 will now be described in more detail. The pad 22 is pivotally attached to the links 24 by any suitable means such as the pair of brackets 34 which are shown as separate elements but which could also be struck out of the material of pad 22. The inner ends of the links 24 are apertured so that they will cooperate with upper and lower trunnion pins 36, 38 which project from adjusting nut members 40, 40'. The upper trunnion pins 36 are engaged by elongated, axially extending, upper trunnion engaging slots 44 formed in a bracket member 46. The bracket member 46 is generally of a shallow U-shape and is mounted for a limited degree of rotation about shaft 26 by means of apertured end bracket portions 46' which pivot about shaft 26. The amount of rotary movement of the bracket 46 which is possible is controlled by a pin 48 which is integrally affixed to the top of the bracket 46. The pin 48 engages the sides of an elongated angled slot 50 positioned in the surface of a sliding plate member 52. The sliding plate member 52 has relieved end portions 52' and 52''. It also has an adjustment nut 54 integrally attached thereto which is adapted to be engaged by a threaded adjustment screw 56 which is affixed to the handle 30. A pair of end bracket members 58 affixed to the side panel portions 18 have slots which cooperate with the relieved end portions 52', 52'' to permit the plate 52 to move only in the axial direction of adjustment screw 56. Since the bracket 46 and the pin 48 thereon are restrained against axial movement but are free to pivot about shaft 26, it will be readily appreciated that axial movement of the sliding plate 52 will cause angled slot 50 to move relative to pin 48 and force the pin 48 and the bracket 46 which supports it to pivot slightly about shaft 26 in either a forward or rearward direction depending upon the direction of rotation of the handle 30. This forward or rearward movement of the bracket 46 will, of course, cause the elongated slots 44 in said bracket 46 to move forwardly or rearwardly. As the slots 44 are displaced they will carry the trunnion pins 36 with them and thus cause the adjusting nuts 40, 40' and the links 24 and the lumbar pad 22 carried by them to tilt either upwardly or downwardly. A plurality of shaft support brackets 60, 62, 64 and 66 are preferably affixed to an angular support member 68 which is in turn affixed to the rear panel portion 16 and have bearing surfaces which engage and support the threaded shaft 26. The intermediate support brackets 62, 64 serve principally to transfer large loads applied by a seat occupant to the lumbar pad 22 to the back frame 14 while the brackets 60 and 66 serve principally to support the shaft 26 in the region of the end bracket portions 46' and to limit axial movement of the bracket 46.

Figure 2:
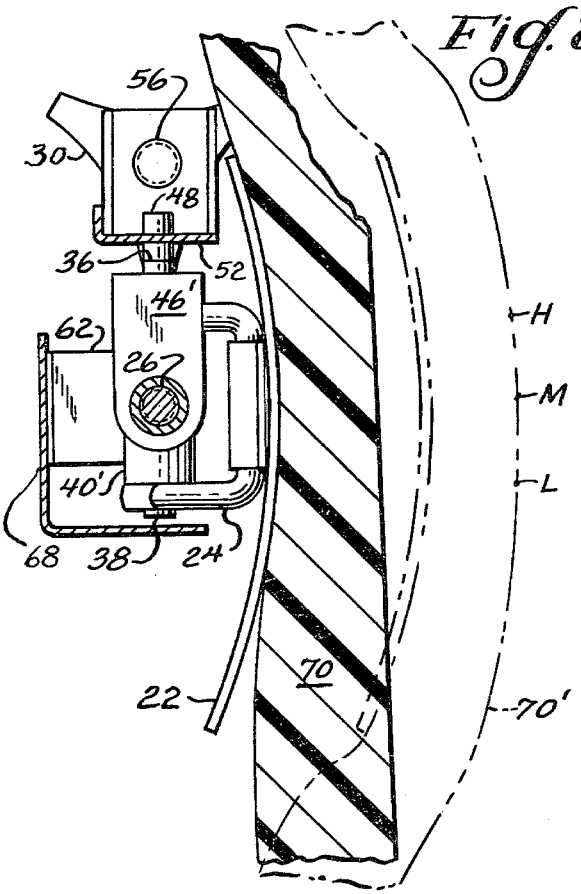
FIG. 2 is a side sectional view taken on line 2—2 of FIG. 6 and illustrating the relationship of the lumbar pad to the back cushion in both the retracted and extended positions of the pad.
Figure 3:
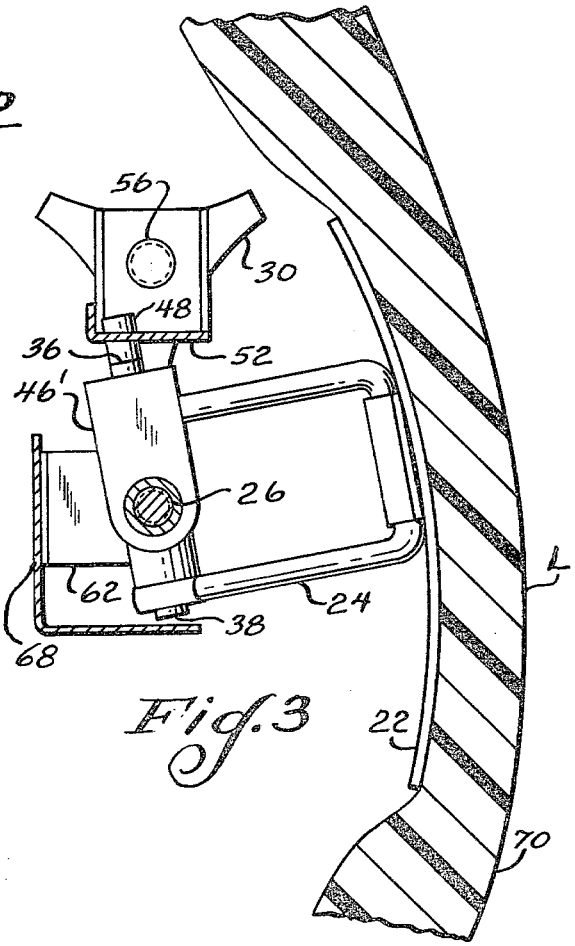
FIG. 3 is a side view illustrating the lumbar pad in its uppermost adjustment position wherein it provides the lowest position of maximum lumbar support.
Figure 4:
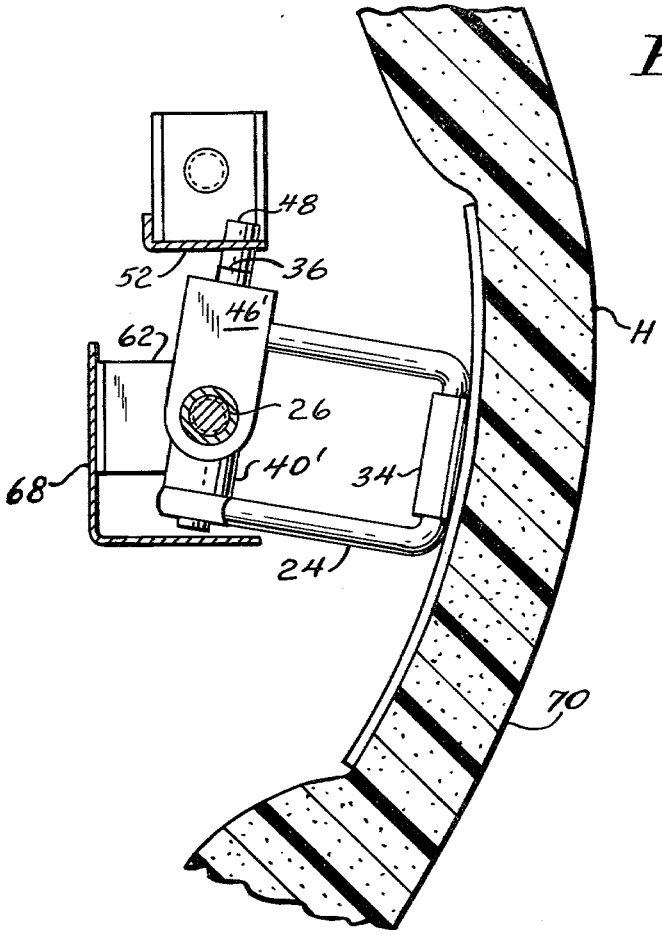
FIG. 4 is a side view similar to FIG. 3 but illustrating the lumbar pad in its lowest position wherein it provides the highest position of maximum lumbar support.

In FIG. 2, the lumbar pad 22 is shown in a substantially retracted position while in FIGS. 3 and 4 it is shown in its fully extended position. In these Figures, a portion of a foam cushion 70 which would be engaged by the lumbar pad 22 in an actual seat is shown. In FIG. 2, the cushion 70 is also shown in dotted lines at 70' in the position it would assume when the lumbar pad 22 is fully extended in a forward direction and without any tilting of the links 24. In this extended dotted line position one can see that the forwardmost point of maximum lumbar support of the cushion is denoted as M. Two other locations, H and L are also denoted. These latter points H and L correspond to the forwardmost upper and lower positions of maximum lumbar support of the cushion when the links 24 are pivoted downwardly as shown in FIG. 4 or pivoted upwardly as shown in FIG. 3. The distance between H and L represents the total degree of vertical movement of the point of maximum lumbar support provided by the adjustment assembly 10. Since the front face of the lumbar pad 22 is of a convex shape, one can readily see that the low adjustment point L will be achieved when the pad is moved upwardly as shown in FIG. 3 and that the highest adjustment point H will be achieved when the pad is tilted downwardly as shown in FIG. 4.

Figure 5:
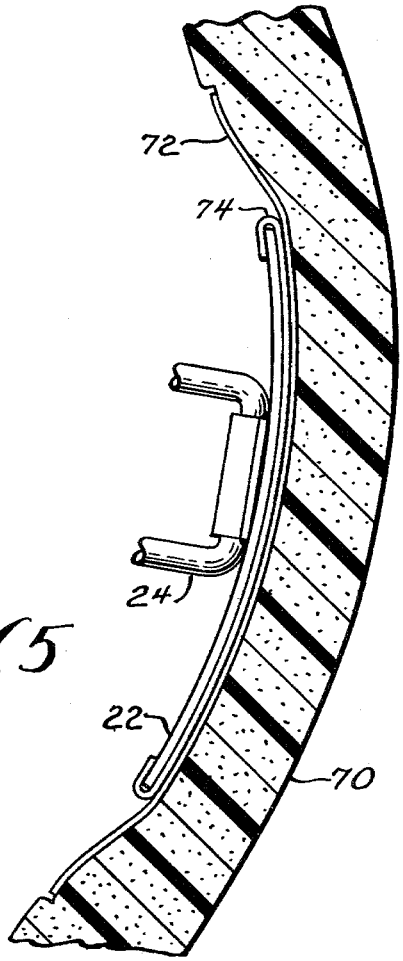
FIG. 5 is a view similar to FIG. 4 but illustrating the addition of low friction materials to the foam pad and lumbar pad to facilitate sliding.

Although friction between the pad 22 and cushion 70 would make tilting movement of the pad 22 much easier when the links 24 are retracted as shown in FIG. 2, it is actually possible to actuate the vertical tilting mechanism by rotating handle 30 when the links 24 are in their extended position. However, tilting adjustment in the forward extended position is greatly facilitated by reducing the friction between the cushion and the pad as shown in FIG. 5 wherein a thin, somewhat rigid plastic sheet 72 of polyethylene or other low friction material is mounted inside the cushion 70 while low friction material such as a layer of nylon cloth 74 is affixed to the front surface of the pad 22.

Figure 6:
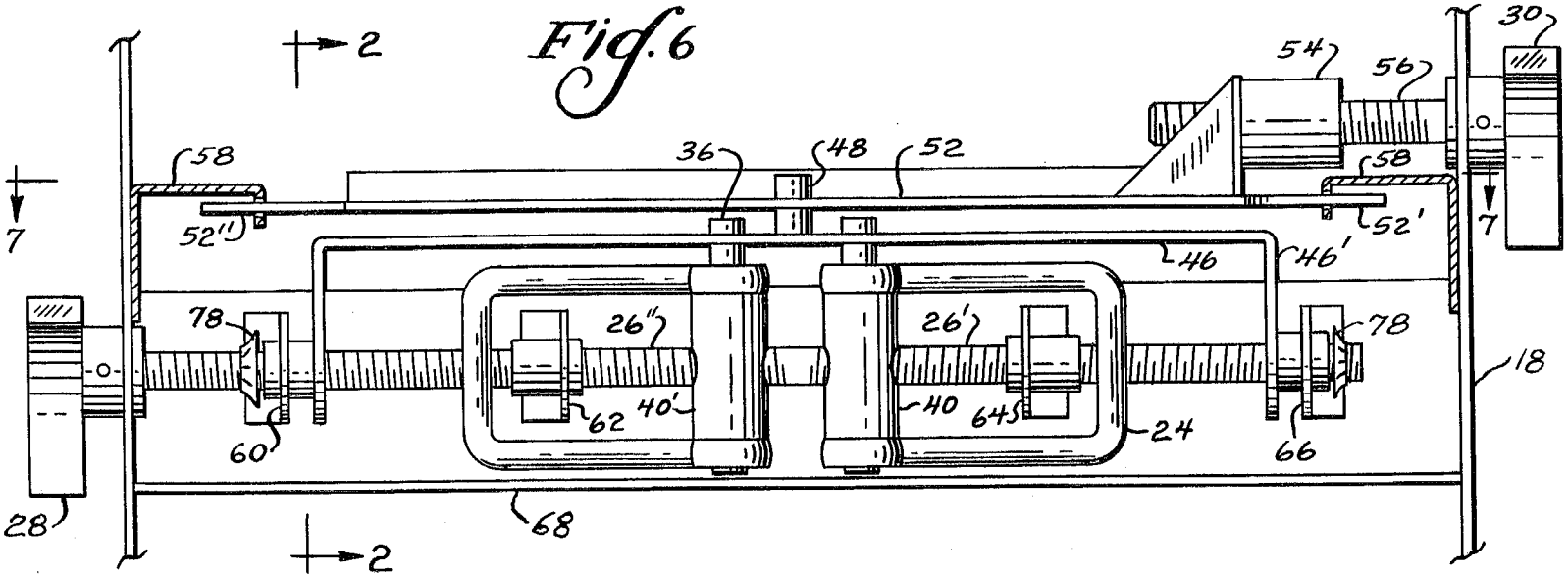
FIG. 6 is a front view of the lumbar assembly with the lumbar pad omitted for clarity.
Figure 7:
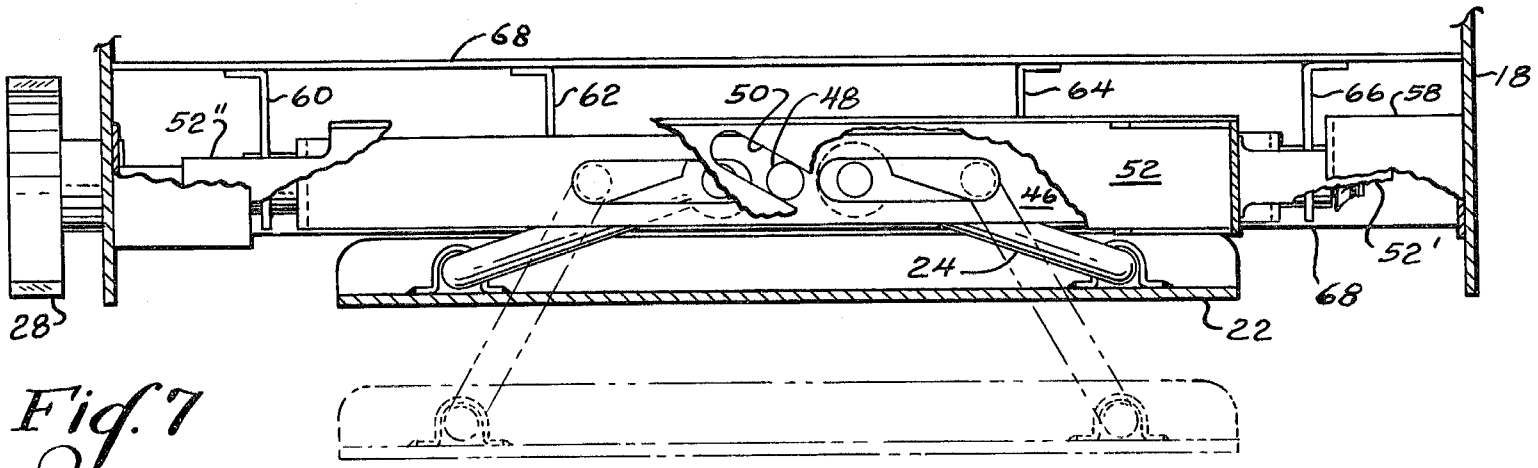
FIG. 7 is a partially broken away top section view taken on line 7—7 of FIG. 6, but with the lumbar pad added to show its retracted position in solid lines and its extended position in dotted lines.

FIGS. 6 and 7 illustrate the adjustment assembly 10 of FIG. 1 as it appears from the front and top respectively. Although the structure has been previously described, one can see a pair of push nuts 78 have been illustrated in FIG. 6 for the purpose of retaining the shaft 26 against axial movement relative to the brackets 60, 66.

I claim as my invention:

1. A seat backrest comprising a rigid back portion and a resilient upholstered cushion member attached to said back portion, a generally horizontal lumbar pad having an elongated, convex-shaped forward surface located between said back portion and said cushion, said pad being pivotally mounted to one end of a pair of spaced link members; each of said link members being supported at its other end for pivotal movement about trunnions located on each of a pair of threaded adjusting nuts; an adjusting shaft having a left handed thread portion in engagement with one of said adjusting nuts and a right handed thread portion in engagement with the other of said adjusting nuts; spaced bearing means for rotationally mounting said adjusting shaft relative to said backrest; first control means for rotating said shaft to cause said adjusting nuts to move toward or away from each other to cause said links to move, respectively, toward a generally parallel position or toward a generally perpendicular position relative to said lumbar pad, said lumbar pad being fully extended when said links are in said generally perpendicular position and fully retracted when said links are in said generally parallel position, and second control means mounted on said rigid back portion for producing a limited degree of rotation of said adjusting nuts about said adjusting shaft and causing a corresponding pivotal movement of said link members and said lumbar pad so as to tilt said lumbar pad and vary the vertical position of the forwardmost portion of its convex-shaped forward surface relative to the back portion.

2. The backrest of claim 1 wherein each of said threaded adjusting nuts has a pair of aligned, link engaging trunnions extending radially from opposed surfaces thereof.

3. The backrest of claim 2 wherein said pair of trunnions are aligned on a generally vertical axis.

4. The backrest of claim 2 wherein said second control means includes a first member which is fixed against axial movement but can rotate slightly about said adjusting shaft and has slot portions which engage one of the trunnions on each adjusting nut, said second control means further including a second member which can move in a path parallel to the axis of said adjusting shaft, and cooperating means on said first and second members for causing said first member to rotate when said second member is moved longitudinally.

5. The backrest of claim 4 wherein said cooperating means includes a pin fixed to one of said first and second members and an angled slot in the other of said first and second members.

6. The backrest of claim 1 wherein at least one layer of low friction material is positioned between the forward surface of said lumbar pad and the portion of said cushion member which is adapted to be engaged by said pad.

7. The backrest of claim 6 wherein a layer of thin but relatively rigid low friction plastic is attached to the back surface of said cushion member and a layer of low friction woven material is adhered to the foward surface of said lumbar pad.

8. The backrest of claim 5 wherein said second member has a threaded nut means thereon which is engaged by a threaded adjustment screw mounted on said back portion, said second member having longitudinally extending end portions which cooperate with apertured brackets affixed to opposite sides of said back portion to permit said second member to move longitudinally while restraining it against rotary movement.

* * * * *